US006248049B1

(12) United States Patent
Scheggetman

(10) Patent No.: US 6,248,049 B1
(45) Date of Patent: Jun. 19, 2001

(54) ENVELOPE

(75) Inventor: Wim Scheggetman, Flynn (AU)

(73) Assignee: Versari International Limited, Tortola (VG)

( * ) Notice: Subject to any disclaimer, the term of this patent is extended or adjusted under 35 U.S.C. 154(b) by 0 days.

(21) Appl. No.: 09/380,947

(22) PCT Filed: Mar. 4, 1998

(86) PCT No.: PCT/AU98/00137

§ 371 Date: Sep. 10, 1999

§ 102(e) Date: Sep. 10, 1999

(87) PCT Pub. No.: WO98/40226

PCT Pub. Date: Sep. 17, 1998

(30) Foreign Application Priority Data

Mar. 10, 1997 (AU) ..... PO5542

(51) Int. Cl.[7] ..... B31B 1/88

(52) U.S. Cl. ..... 493/188; 493/917; 493/923; 229/80.5

(58) Field of Search ..... 493/186, 188, 493/264, 243, 917, 923; 229/80.5, 309

(56) References Cited

U.S. PATENT DOCUMENTS

| | | | |
|---|---|---|---|
| 4,012,268 | * | 3/1977 | Johnsen . |
| 4,923,111 | | 5/1990 | Down . |
| 5,290,225 | * | 3/1994 | Youner . |
| 5,429,576 | * | 7/1995 | Doderer-Winkler . |
| 5,464,255 | * | 11/1995 | Schildmeyer . |
| 5,921,065 | * | 7/1999 | Slyster et al. . |

FOREIGN PATENT DOCUMENTS

| | | |
|---|---|---|
| 2089392A | 2/1993 | (AU) . |
| 297 09 201 U | 9/1997 | (DE) . |
| 297 09 202 U | 9/1997 | (DE) . |
| 302796A | 2/1989 | (EP) . |
| 568266A | 11/1993 | (EP) . |
| 2400465A | 3/1979 | (FR) . |

* cited by examiner

*Primary Examiner*—Eugene Kim
(74) *Attorney, Agent, or Firm*—Dinsmore & Shohl LLP

(57) ABSTRACT

A printable sheet is disclosed including a first portion and a second portion foldable together about a fold line and adherable together by adhesive means. The printable sheet also includes frangible means for allowing the sheet to be unfolded. The adhesive means is active and, until use, is covered by a liner.

2 Claims, 4 Drawing Sheets

ENVELOPE

TECHNICAL FIELD

This invention relates to a printable sheet which can be folded and adhered to itself to form a substantially sealed envelope.

BACKGROUND ART

In one known prior art system, an employee's pay details are provided in a two-ply envelope in which the bottom layer takes a carbon imprint from an impact printer which strikes the top layer. To access the pay details, the employee separates the top layer from the lower layer and retains the lower layer which bears the carbon imprint.

Prior art envelopes formed from a folded sheet are known from European Patent Application 302,796, Australian Patent Application 20893/92, European Patent Application 568,266 and French Patent Publication 2,400,465.

DISCLOSURE OF INVENTION

This invention in one aspect resides in a printable sheet which can be passed through a printer, the printable sheet including:

active adhesive means for adhering portions of the printable sheet together when the sheet is folded to thereby form a substantially sealed envelope, removable liner means for covering the active adhesive means prior to use, wherein, in use, the printable sheet including the active adhesive means and removable liner means is passed through a printer and the liner means is then removed to facilitate sealing of the envelope.

As used herein, the term "active" is used to indicate that the adhesive does not require heat, pressure, moisture or the like.

Preferably, the printable sheet includes a first portion and a second portion foldable together about a fold line to define a two-ply region bounded on one side by the fold line, the adhesive means extend substantially continuously about the periphery of the remaining sides of the two-ply region whereby, in combination with the fold line, the interior of the two-ply region may be rendered inaccessible, frangible means are disposed inside the adhesive means such that the first and second portions may be unfolded about the fold line when the frangible means are broken.

In another aspect the invention resides in a method of using a printable sheet including a fold line dividing the sheet into portions, active adhesive means for adhering the portions together when folded, and liner means for covering the active adhesive, the method including:

printing information on the sheet;

removing the liner means; and folding and adhering the portions of the sheet together.

BRIEF DESCRIPTION OF DRAWINGS

In order that this invention may be more easily understood and put into practical effect, reference will now be made to the accompanying drawings which illustrate a preferred embodiment of the invention, wherein.

BEST MODE

Figure 1:
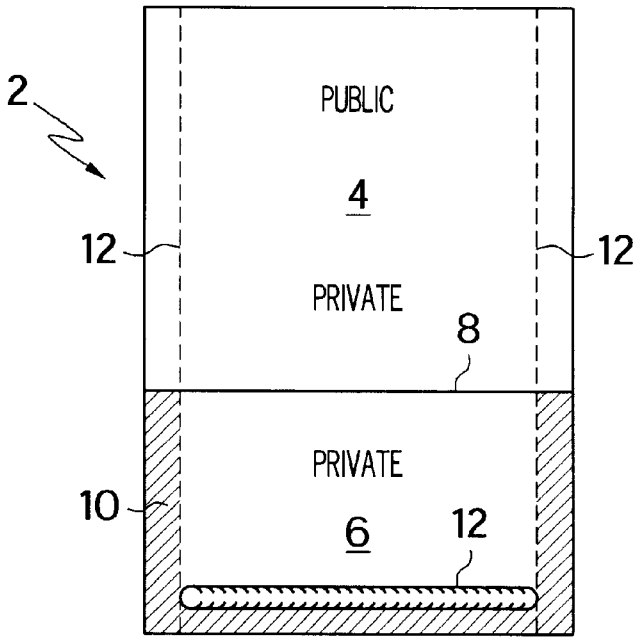
FIGS. 1 to 4 are a series of schematic plan views of a printable sheet according to a first embodiment of the present invention.

With reference to FIGS. 1 to 4 there is illustrated a first embodiment of the present invention.

Printable sheet 2 includes a first portion 4 and a second portion 6 separated by a fold line 8.

Second portion 6 includes adhesive means 10 about all sides of the second portion 6 with the exception of the side adjacent fold line 8, ie. the adhesive means extends about three sides of second portion 6.

Adhesive means 10 consists of an active adhesive which, until use, is covered by liner means (not shown). The liner means includes a release layer which facilitates removal of the liner means from the active adhesive.

Second portion 6 also includes frangible means 12 located inside the adhesive means 10 and similarly extending about all sides of the second portion 6 with the exception of the side adjacent fold line 8. Thus, the frangible means 12, like the adhesive means 10, extends about three sides of the second portion 6 which is rectangular in shape.

First portion 4, which is also rectangular in shape, includes frangible means 12 along the two lateral sides of first portion 4.

Figure 2:
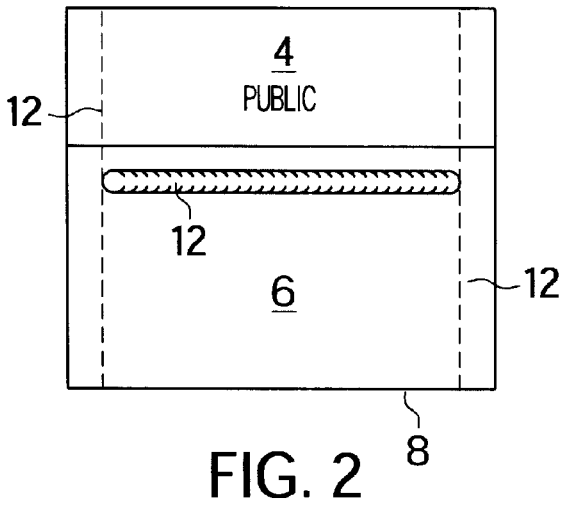

When the adhesive is exposed by removing the covering liner, and the first and second portions are folded together, the printable sheet forms a two-ply sealed envelope as shown in FIG. 2 in which the private information is inaccessible.

It will be noted that a portion of the first portion 4 protrudes from the top of the two-ply envelope. This protruding portion carries public information such as, for example, the identity of the employee whose private pay details are enclosed within the sealed two-ply envelope.

When in the folded configuration shown in FIG. 2, the frangible means extending along the lateral sides of the first portion align with the frangible means extending along the lateral sides of the second portion. In the illustrated embodiment the frangible means takes the form of lines of perforations and therefore the lateral portions of the first and second portions which are located outside the lines of perforations (and which are adhered together) can be manually separated as shown in FIG. 3.

Figure 3:
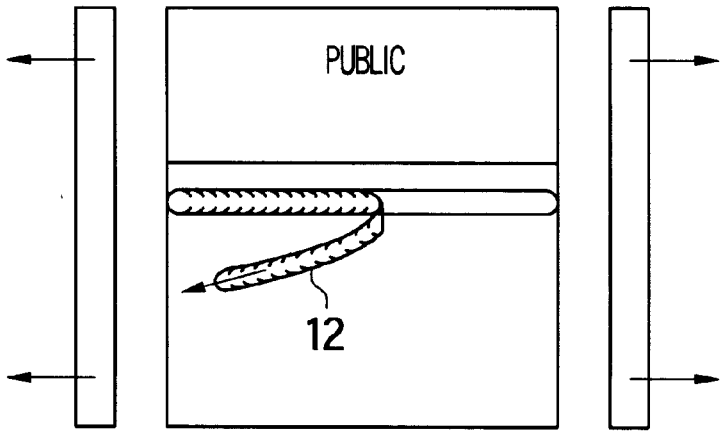

As shown in FIG. 3, the frangible means which extends across the side of second portion 6 which is distal from fold line 8 is also broken. In the illustrated case the frangible means takes the form of a "zipper" which can be pealed away as shown in FIG. 3. In an alternative embodiment, the "zipper" can be replaced by a line of perforations.

Figure 4:
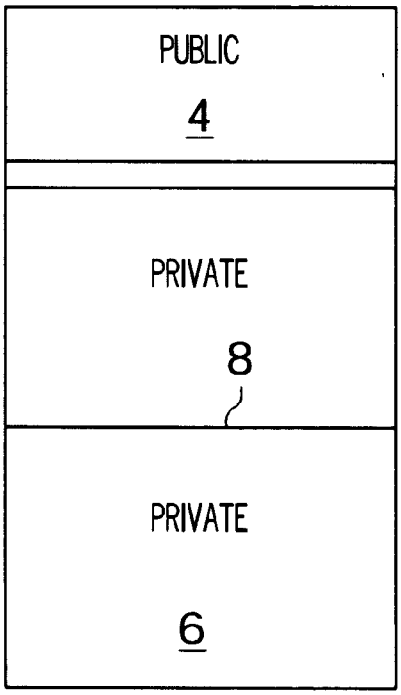
Figure 5:
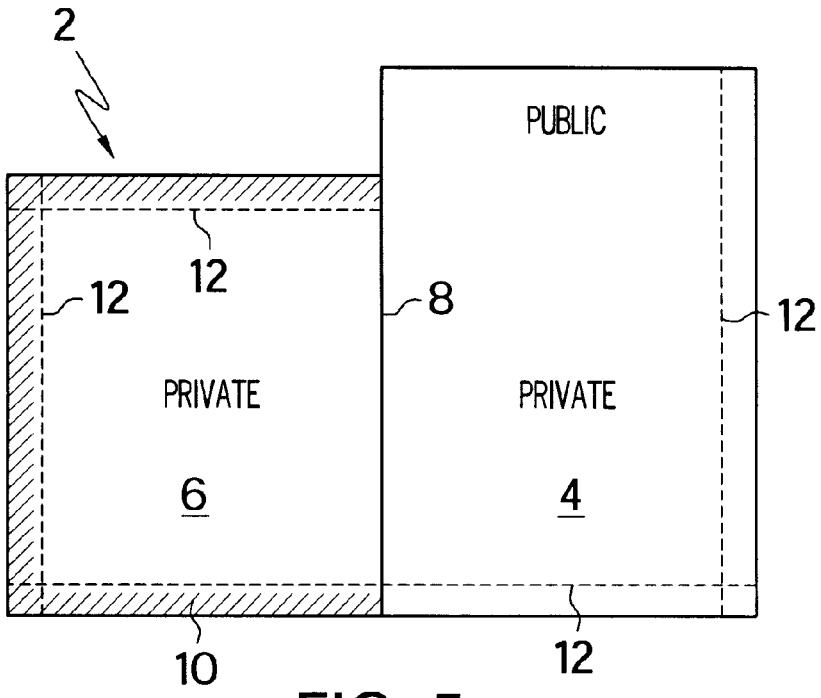
FIGS. 5 to 8 are a series of schematic plan views of a printable sheet according to a second embodiment of the present invention.

Once the frangible means have been broken, the second portion can be folded back down as shown in FIG. 4 thereby revealing the private information. It will be noted that a thin horizontal strip of the second portion 6 remains adhered to the first portion 4.

Referring now to FIGS. 5 to 8 there is shown a second embodiment in which the same reference numerals have been used to designate the same features.

In this embodiment the fold line 8 is vertical rather than horizontal and this has resulted in a re-arrangement of the frangible means disposed on first portion 4.

Figure 6:
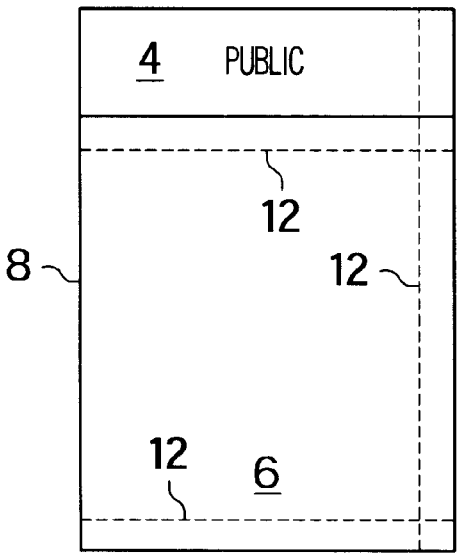
Figure 7:
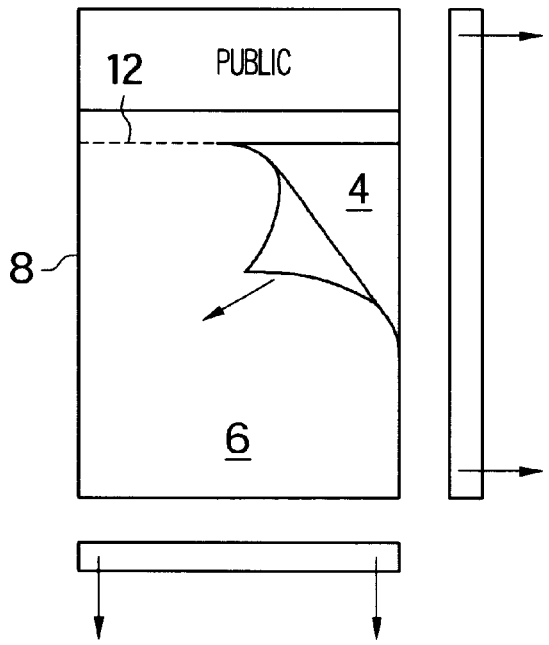
Figure 8:
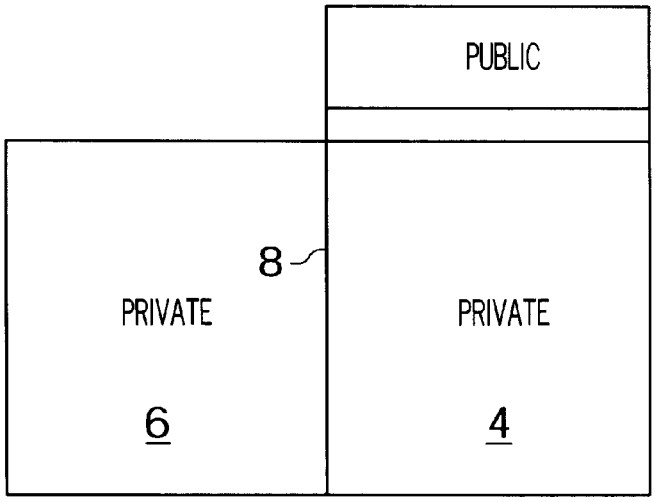

As previously, the adhesive means is exposed by removing the liner and the first and second portions are folded together to form the sealed two-ply envelope illustrated in FIG. 6.

As previously, the frangible means are broken to allow the unfolding of the first and second portions. However, in this case, the zipper has been eliminated and the final frangible means 12 is shown being broken by pulling the second portion 6 away from the first portion 4.

Whilst in both embodiments the adhesive means 10 have been disposed on the second portion 6, the adhesive means could equally be disposed on the first portion 4.

Whilst in both embodiments the first portion has included frangible means along two sides thereof, it need not include any frangible means, ie. the frangible means about three sides of the second portion could be broken leaving three strip-like portions adhered to the first portion.

Whilst, the adhesive means has been shown as being continuous, it will be appreciated that the adhesive means may be discontinuous or intermittent.

The preferred embodiment of the invention provides a confidential envelope which is formed from a single sheet of paper which can be passed through a non-impact printer such as, for example, a laser printer. Thus the need for carbon paper or its equivalents is eliminated.

The adhesive of the present invention, which is always active, is exposed by manually removing the covering liner. In contrast, many of the prior art constructions require machinery to apply heat, pressure, moisture or the like to activate the adhesive. Furthermore, in many of the prior art constructions, the application of the adhesive and the folding of the sheet must occur in quick succession during manufacture. In contrast, with the present invention the interval between manufacture (ie. application of the adhesive) and use (ie. printing and removal of the liner) may be variable.

In summary, the present invention provides a sheet which can be formed into an envelope after printing and manual removal of the liner.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

What is claimed is:

1. A printable sheet which can be passed through a printer, the printable sheet including:

active adhesive present on the printable sheet prior to printing and capable of adhering portions of the printable sheet together when the sheet is folded to thereby form a substantially sealed envelope;

a removable liner covering the active adhesive wherein, in use, the printable sheet including the active adhesive and removable liner is passed through a printer and the liner is then removed to facilitate sealing of the envelope;

a first portion and a second portion foldable together about a fold line to define a two-ply region bounded on a side by the fold line, the first portion overlapping the second portion to form an accessible region when the sheet is folded, and the active adhesive being disposed such that it is between the portions comprising the two-ply region when the sheet is folded, whereby at least a portion of an interior of the two-ply region is inaccessible when the sheet is folded; and a frangible portion disposed on the two-ply region such that the first and second portions may be unfolded about the fold line when the frangible portion is broken.

2. A printable sheet as claimed in claim 1, wherein when the frangible portion is broken, the accessible region of the first portion remains integral with the remainder of the first portion.

* * * * *